United States Patent [19]

Miyamoto

[11] 4,393,274

[45] Jul. 12, 1983

[54] AM STEREO RECEIVER

[75] Inventor: Yukihiko Miyamoto, Tokyo, Japan

[73] Assignee: Trio Kabushiki Kaisha, Tokyo, Japan

[21] Appl. No.: 293,839

[22] Filed: Aug. 18, 1981

[30] Foreign Application Priority Data

Aug. 20, 1980 [JP] Japan ..... 55-117754[U]

[51] Int. Cl.[3] ..... H04H 5/00

[52] U.S. Cl. ..... 179/1 GS; 455/308; 455/317

[58] Field of Search ..... 179/1 GJ, 1 GS; 329/131-136; 455/210, 211, 216, 296, 302, 303, 305, 308-312, 317

[56] References Cited

U.S. PATENT DOCUMENTS 3,909,725 9/1975 Baghdady ..... 455/317 X 4,267,605 5/1981 Matsuzawa et al. ..... 455/296 X

*Primary Examiner*—A. D. Pellinen

*Attorney, Agent, or Firm*—Gerald J. Ferguson, Jr.; Joseph J. Baker

[57] ABSTRACT

An AM stereo receiver for receiving AM stereo broadcasting of an AM-PM or AM-FM system. Between an IF AM signal amplifier and an limiter is interposed a 5 or more frequency multiplier so that the frequency of a spurious signal radiated from the limiter may lie outside of the frequency range handled by the RF tuner.

2 Claims, 1 Drawing Figure

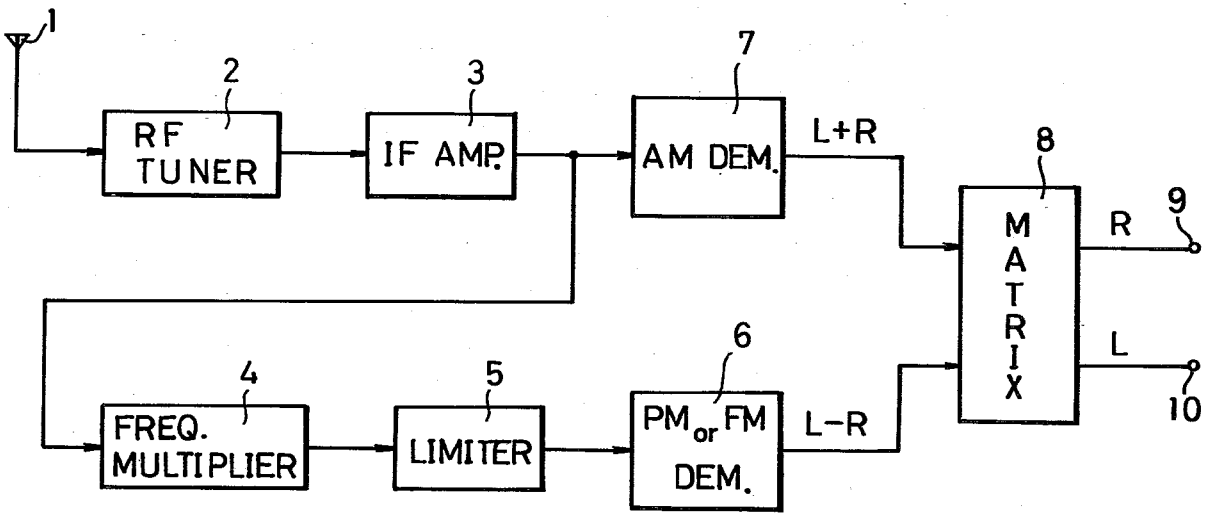
1
2
RF TUNER
3
IF AMP.
7
AM DEM.
L+R
4
FREQ. MULTIPLIER
5
LIMITER
6
PM or FM DEM.
L−R
8
MATRIX
R
9
L
10

AM STEREO RECEIVER

BACKGROUND OF THE INVENTION

1. Field of the Invention

The present invention relates to an AM stereo receiver for receiving AM stereo broadcasting.

2. Description of the Prior Art

An AM stereo receiver receives an RF AM stereo signal of the AM stereo broadcasting system. The AM stereo broadcasting is now under study for practical operation in near future.

One of RF AM stereo signals of AM stereo broadcasting systems which are now regarded as very promising is an RF AM stereo signal of an AM-PM system (such as a Magnavox system) and another is an RF AM stereo signal of an AM-FM system (such as a Belar system).

The RF AM stereo signal of the AM-PM system is one that a radio-frequency carrier (in an AM broadcasting frequency band ranging from 535 to 1605 KHz both in U.S.A. and Japan) phase-modulated by a difference signal (L−R) has been amplitude modulated by a sum signal (L+R). The difference signal (L−R) is a difference signal between a left signal (L) having an audio frequency and a right signal (R) having an audio frequency. The sum signal (L+R) is a sum signal of the right and left signals (R) and (L).

Th RF AM stereo signal of the AM-FM stereo system is one that a radio-frequency carrier frequency-modulated by the difference signal (L−R) has been amplitude modulated by the sum signal (L+R).

A conventional AM stereo receiver comprises an IF AM tuner for selecting an RF AM stereo signal and converting it into an IF AM stereo signal the carrier of which has a lower intermediate frequency (such as 450 KHz) than the carrier frequency of the RF AM stereo signal; an IF AM signal amplifier for amplifying the IF AM stereo signal from the IF AM tuner; a limiter for amplitude limiting the amplified IF AM stereo signal to obtain an IF PM (or FM) difference signal is one that a carrier of a frequency equal to the frequency of the non-phase- (or frequency-) modulated carrier of the amplified IF AM stereo signal has been phase (or frequency) modulated by the difference signal (L−R); a PM (or FM) demodulator for phase (or frequency) demodulating the IF PM (or FM) difference signal from the limiter into the difference signal (L−R); an AM demodulator for amplitude demodulating the IF AM stereo signal from the IF AM signal amplifier into the sum signal (L+R); and a matrix circuit for deriving the right and left signals (R) and (L) from the difference signal (L−R) from the PM (or FM) demodulated and the sum signal (L+R) from the AM demodulator.

With the AM stereo receiver of such a construction, the IF AM stereo signal available from the IF AM signal amplifier is such a signal that a carrier having an intermediate frequency has been amplitude modulated by the sum signal (L+R). If the IF PM (or FM) difference signal from the limiter has not sufficiently been amplitude limited, then the difference signal (L−R) from the PM (or FM) demodulator contains the sum signal (L+R) component, with the result that the right and left signals (R) and (L) available from the matrix circuit cannot well be separated from each other. To avoid this, the the limiter must be arranged to sufficiently amplitude limit the IF AM stereo signal so that the resulting IF PM (or FM) difference signal may be free from amplitude variations.

In the case where the limiter has such a construction, however, a spurious signal composed of a fundamental wave component of a frequency equal to the intermediate frequency (hereinafter referred to as 450 KHz for the sake of brevity) of the IF AM stereo signal and its higher harmonic components radiate from the limiter at relatively high levels and this spurious signal centers into the RF AM tuner, the IF AM signal amplifier and so forth to adversely effect them. The frequency of the fundamental wave component of the spurious signal is 450 KHz and the frequencies of second, third, fourth, fifth . . . harmonic components are 900, 1350, 1800, 2250 KHz . . . On the other hand, the RF AM tuner handles an RF AM stereo signal having a carrier frequency of 535 to 1605 KHz, a local oscillation signal having a frequency in the range of 985 (=535+450) to 2055 (=1605+450) KHz or 85 (=535−450) to 1155 (1605−450) KHz and an IF AM stereo signal having a carrier frequency of 450 KHz. Accordingly, the frequencies of the fundamental wave component and the second, third and fourth harmonic components are in the frequency range of the signals handled by the RF AM tuner. As a result of this, the operation of the RF AM stereo tuner is disturbed by the fundamental wave component and the second, third and fourth harmonic components, so that no good reception is obtained. To avoid such disturbance, it is necessary to take a step such as, for example, electromagnetic shielding of the limiter and this makes the AM stereo receiver bulky, complex and expensive as a whole.

SUMMARY OF THE INVENTION

It is therefore an object of the present invention to provide a novel AM stereo receiver which is free from the abovesaid defect of the prior art.

According to an aspect of the present invention, the IF AM stereo signal from the IF AM signal amplifier is frequency multiplied to obtain a frequency-multiplied IF AM stereo signal which has a frequency higher than the highest frequency of the signal handled by the RF AM tuner, and the frequency-multiplied IF AM stereo signal is supplied to the limiter. In such a case, since the limiter is used, there is the possibility that a fundamental wave component of a frequency equal to the frequency of the frequency-multiplied IF AM stereo signal and its high harmonic components are radiated as a spurious signal from the limiter. However, the frequency of the spurious signal or even the fundamental wave component is outside of the frequency range of the signals handled by the RF AM tuner.

Accordingly, in the AM stereo receiver of the present invention the operation of the RF AM tuner is not disturbed by the spurious signal from the limiter. Therefore, there is no need of providing means for preventing the influence of the spurious signal, such as electromagnetic shielding of the limiter. Thus the AM stereo receiver of the present invention can be made small, simple and inexpensive as a whole.

Other objects, features and advantages of the present invention will become more fully apparent from the following detailed description taken in conjunction with the accompanying drawings.

BRIEF DESCRIPTION OF THE DRAWING

The accompanying drawing is a block diagram illustrating an embodiment of the AM stereo receiver of the present inventions.

DESCRIPTION OF THE PREFERRED EMBODIMENT

The illustrated embodiment of the present invention is provided with an RF AM tuner 2 which receives via an RF AM signal receiving antenna 1 an RF AM stereo signal of the aforesaid AM-PM or AM-FM system. The RF AM tuner 2 may be of the same construction as an RF tuner employed in an ordinary AM receiver and selects one of RF AM signals and converts the selected signal into an IF AM stereo signal the carrier frequency of which is an intermediate frequency lower than the frequency of the selected RF AM stereo signal, such as 450 KHz.

The IF AM stereo signal from the RF AM tuner 2 is amplified by an IF AM signal amplifier 3 which may be of the same construction as an IF AM signal amplifier employed in an ordinary AM receiver.

The IF AM stereo signal amplified by the IF AM signal amplifier 3 is provided to a freuqency multiplier 4, wherein it is frequency multiplied to obtain a frequency-multiplied IF AM stereo signal the carrier frequency of which is five times higher than that of the input IF AM stereo signal, that is, $5\times450=2250$ KHz. As the frequency multiplier 4, various known frequency multipliers can be employed.

The frequency-multiplied IF AM stereo signal thus obtained is applied to a limiter 5, wherein it is amplitude limited to obtain a frequency-multiplied IF PM or FM difference signal. The limiter 5 may be any of various known ones.

The frequency-multiplied IF PM or FM difference signal derived from the limiter 5 is supplied to a PM or FM demodulator 6, wherein it is phase or frequency demodulated to obtain a difference signal (L−R). The PM or FM demodulator 6 may be a known one.

On the other hand, the IF AM stereo signal from the IF AM signal amplifier 2 is provided to an AM demodulator 7 such as used in an ordinary AM receiver. The AM demodulator 7 amplitude demodulates the IF AM stereo signal to obtain a sum signal (L+R).

The difference signal (L−R) from the PM or FM demodulator 6 and the sum signal (L+R) from the AM demodulator 7 are both applied to a matrix circuit 8, wherein they are added together and substracted one from the other to obtain right and left signals (R) and (L).

The right and left signals (R) and (L) thus obtained are delivered to output terminals 9 and 10.

As described above, according to the illustrated embodiment of the AM stereo receiver of the present invention, stereo signals of the AM-PM or AM-FM system of the AM stereo broadcasting system, that is, the right and left signals (R) and (L), are reproduced using the 5 frequency multiplier 4 interposed between the IF AM signal amplifier 3 and the limiter 5. In consequence, the limiter 5 is supplied with the frequency-multiplied IF AM stereo signal which has a frequency five times higher than that of the IF AM stereo signal from the IF AM amplifier 3. The limiter 5 is required to sufficiently amplitude limit the frequency-multiplied IF AM stereo signal. Otherwise, the difference signal (L−R) from the PM or FM demodulator 6 would contain the component of the sum signal (L+R), with the result that the right and left signals (R) and (L) from the matrix circuit 8 cannot well be separated from each other. There is a fear that a spurious signal composed of a fundamental wave component of a frequency equal to that of the frequency-multiplied IF AM stereo signal and its high harmonic components is radiated from the limiter 5. However, the frequency of the fundamental wave component of the spurious signal is 2250 KHz ($450\times5$ KHz). On the other hand, the RF AM tuner 2 handles the RF AM stereo signal which has a carrier frequency in the range of 535 to 1605 KHz, the local oscillation signal which has a frequency of 983 (=535+450) to 2055 (=1605+450) KHz or 85 (525−450) to 1155 (1605−450) KHz and the IF AM stereo signal which has a carrier frequency of 450 KHz. Accordingly, the frequency of the fundamental wave component of the spurious signal falls outside of the frequency range of the signals handled by the RF AM tuner 2. Of course, the frequencies of the high harmonic components of the spurious signal are also outside of the frequency range of the signals handled by the RF AM tuner 2.

Accordingly, in the AM receiver of the present invention, the operation of the RF AM tuner 2 is not distributed by the spurious signal that is radiated from the limiter 5. This eliminates the necessity of providing means for preventing the influence of the spurious signal, such as electromagnetic shielding of the limiter 5, ensuring to make the AM stereo-receiver small, simple and inexpensive as a whole.

While in the foregoing the IF AM stereo signal from the IF AM signal amplifier is frequency multiplied by the frequency multiplier 4 up to a frequency five times as high as the carrier frequency of the IF AM stereo signal itself, it will be seen that the frequency need not always be five times higher than the carrier frequency of the IF AM stereo signal but that the point is to frequency multiply the signal up to a frequency higher than the frequency range of the signals handled by the RF AM tuner.

It will be apparent that many modifications and variations may be effected without departing from the scope of the novel concepts of this invention.

What is claimed is:

1. An AM stereo receiver comprising:

an RF AM tuner for selecting and converting an RF AM stereo signal of an AM-PM or AM-FM system into an IF AM stereo signal;

an IF AM signal amplifier for amplifying the IF AM stereo signal from the RF AM tuner;

a frequency multiplier for frequency multiplying the IF AM stereo signal from the IF AM signal amplifier to obtain a frequency-multiplied IF AM stereo signal having a frequency higher than the maximum frequency of a signal handled by the RF AM tuner;

A limiter for amplitude limiting the frequency-multiplied IF AM stereo signal from the frequency multiplier to obtain a frequency-multiplied IF PM or FM difference signal;

a PM or FM demodulator for phase or frequency modulating the frequency-multiplied IF PM or FM difference signal from the limiter to obtain a difference signal;

an AM demodulator for amplitude demodulating the IF AM stereo signal from the IF AM signal amplifier to obtain a sum signal; and a matrix circuit for deriving a right signal and a left signal from the difference signal from the PM or FM demodulator and the sum signal from the AM demodulator.

2. An AM stereo receiver according to claim 1 wherein the frequency multiplier frequency multiplies the IF AM stereo signal up to a frequency five times or more its frequency.

* * * * *